United States Patent [19]

Engelskirchen

[11] Patent Number: 4,637,336

[45] Date of Patent: Jan. 20, 1987

[54] PERMANENT ANCHORING ARRANGEMENT FOR FLOATING STRUCTURES

[75] Inventor: Jürgen Engelskirchen, Hamburg, Fed. Rep. of Germany

[73] Assignee: Blohm & Voss AG, Hamburg, Fed. Rep. of Germany

[21] Appl. No.: 679,569

[22] Filed: Dec. 7, 1984

[30] Foreign Application Priority Data

Dec. 7, 1983 [DE] Fed. Rep. of Germany ..... 33441170

[51] Int. Cl.[4] ..... B63B 21/50

[52] U.S. Cl. ..... 114/293; 114/230; 441/5

[58] Field of Search ..... 114/230, 293; 441/3–5

[56] References Cited

U.S. PATENT DOCUMENTS 3,414,918 12/1968 Petrie et al. ..... 441/5
3,556,170 1/1971 Bily ..... 114/230
4,321,720 3/1982 Havre ..... 441/5

FOREIGN PATENT DOCUMENTS 3043755 5/1982 Fed. Rep. of Germany .

*Primary Examiner*—Sherman D. Basinger
*Attorney, Agent, or Firm*—Nils H. Ljungman

[57] ABSTRACT

A relatively permanent anchoring arrangement for a decommissioned tanker which is connected to an undersea flexible transfer hose, uses a spreader beam suspended under the tanker by a plurality of mooring hawsers which are guided on the hull of the tanker. A support column structure having a vertical axis is suspended from and supported by the spreader beam. The support column structure comprises a diver's chamber which includes a massive peripheral bearing which enables relative rotary movement between the diver's chamber and the support column. The diver's chamber is anchored and fastened using a plurality of anchor chains. The diver's chamber can be evacuated and made dry for a diver to enter for purposes of bearing inspection maintenance. A fluid proof rotary joint housed in the diver's chamber is provided for connecting an undersea flexible transfer hose to a rigid transfer tube emerging from the tanker at the bottom thereof. Anchoring in high seas is effective by this arrangement.

15 Claims, 7 Drawing Figures

PERMANENT ANCHORING ARRANGEMENT FOR FLOATING STRUCTURES

BACKGROUND OF THE INVENTION

1. Field of the Invention:

This invention generally relates to anchoring arrangements for floating structures and, more particularly, to relatively permanent anchoring arrangements for floating structures, such as decommissioned tankers.

2. Description of the Prior Art:

There are several prior art anchoring arrangements known, which comprise any of the known types of anchoring systems. These cater only to the requirements of tankers and other floating structures which are either at a dock or a harbor. Occasionally, certain conventional anchoring arrangements are used to anchor vessels in the open sea as well. However, conventional anchoring will not be very effective if the floating structure or vessel is in high seas, especially when it is required to connect a transfer hose or an underwater pipeline to the floating vessel. Even with anchoring, a certain degree of shifting of the floating structure, or even a certain degree of rotation of the floating structure, might occur in high seas. At least one consequence of such shifting or rotation is that the transfer hose, for example, tends to get damaged or even disconnected, causing serious consequences. The problem is especially serious in the case of ocean vessels, such as decommissioned tankers, wherein there is need for having at least a transfer hose constantly connected to the tanker through the ocean water either to the sea bed or the shore or another vessel. Certain underwater structural arrangements have been used in heretofore to cater to the needs of stably and permanently anchoring decommissioned tankers, simultaneously making provision for a transfer pipe connected between the tanker and the sea bed. However, prior art arrangements have always required a significant mass of steel to fabricate the underwater structure, making the equipment expensive from the point of view of installation and maintenance. Furthermore, it has been found that it is desirable to provide an underwater anchor means which permits relative rotary movement between the tanker superstructure and the anchoring arrangement to make a provision for oscillatory and rotary swaying movements of the tanker superstructure in high seas. Preferably, the underwater means should have a massive bearing mechanism to easily permit such movement. Also, it is desirable that there should be easy access for maintenance personnel to reach the bearing mechanism and attend to maintenance and replacement work, preferably in a dry atmosphere. Such facilities are not available in any known prior art anchoring arrangement.

There is, therefore, a great need for an anchoring arrangement devoid of the disadvantages and limitations of prior art while including the more desirable features which are discussed above.

OBJECTS OF THE INVENTION

An object of this invention is to provide a relatively permanent anchoring arrangement for use in high seas to fasten floating structures such as tankers, in particular, decommissioned tankers. It is also an object of the invention to provide an anchoring arrangement which can support a transfer hose which can remain attached to the tanker bottom from the sea bed in spite of oscillatory and rotary movements of the tanker in high seas.

The invention also provides an anchoring arrangement which uses a support column which takes the form of "one point vertebra", the support column having a vertical axis about which the tanker can oscillate relative to the anchoring arrangement. The invention also provides an anchoring arrangement having a hollow structure and several anchoring ropes and several mooring hawsers which lead to the structure. The invention further provides a relatively simple, reliable anchoring arrangement for a floating structure having improved accessibility for maintenance and repair.

Described herein is a Submerged-Anchor-Leg-Mooring structure (SUALM) featuring a relatively permanent anchoring arrangement which accepts a flexible pipeline extending from the sea bed to the mooring structure. The flexible pipeline may carry a liquid or gaseous medium. The Submerged-Anchor-Leg-Mooring structure advantageously features an underwater chamber housing a support column and a massive vertical pivot bearing, the chamber being formed in the manner of a diver's lock.

SUMMARY OF THE INVENTION

The invention in its broad form comprises an underwater anchoring arrangement for floating structures, such as a tanker in high seas, of the type using a plurality of anchoring ropes and mooring hawsers, the tanker having a hull, the anchoring arrangement comprising: a spreader beam suspended in a substantially horizontal manner under the tanker and supported by a plurality of mooring hawsers which are guided on the hull of the tanker; a support column structure suspended from and supported by said spreader beam, said support column structure having a substantially vertical axis, said support column structure including a diver's chamber, said chamber including bearing means enabling relative rotary motion of said diver's chamber about said vertical axis with respect to said support column structure; and a plurality of anchor chains connected to and holding down said diver's chamber so as to anchor the tanker through the support column structure, whereby the tanker together with the spreader beam is capable of rotary oscillatory movement about said vertical axis with respect to the anchored diver's chamber.

A preferred embodiment of the invention described herein features a vertical support column in the form of a single hub structure or a "one point vertebra", to which several anchoring ropes and several mooring hawsers are radially connected. The arrangement described is termed Submerged-Anchor-Leg-Mooring and provides for relatively permanent anchoring of a tanker or similar vessel, which simultaneously provides for the retaining of a transfer tube connected to the tanker from the ocean bed through the anchoring structure. The described arrangement features an underwater chamber housing a massive vertical pivot-type bearing which facilitates and permits relative rotary movement of the tanker superstructure with respect to the underwater anchoring arrangement. The chamber is constructed on the diver's lock principle and can be evacuated to provide a dry containment for maintenance personnel to complete replacement and maintenance work in the chamber. A spreader bar in the form of an underwater beam is suspended from the tanker preferably using mooring hawsers. Advantageously, the pivot bearing is made at least partly in sections which can be fixed to the underwater chamber on the inside. Expediently, the bearing sections can be swung out by means of hoist which is contained within the underwater chamber which can be evacuated to provide a dry atmosphere during maintenance operations.

BRIEF DESCRIPTION OF THE DRAWINGS

A more detailed understanding of the invention may be had from the following description of the preferred embodiment, given by way of example and to be read in conjunction with the accompanying drawings wherein.

DESCRIPTION OF THE PREFERRED EMBODIMENT

Figure 2:
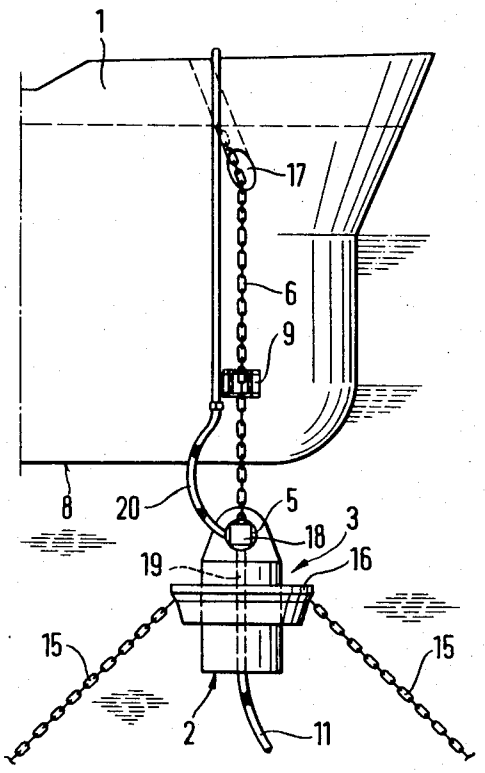
FIGS. 1 and 2 show, front and side views of an anchoring arrangement in accordance with the invention of a floating structure with a spreader bar or beam disposed under the bottom of the tanker and held by mooring hawsers located in a guiding seating in the side of the tanker.
Figure 1:
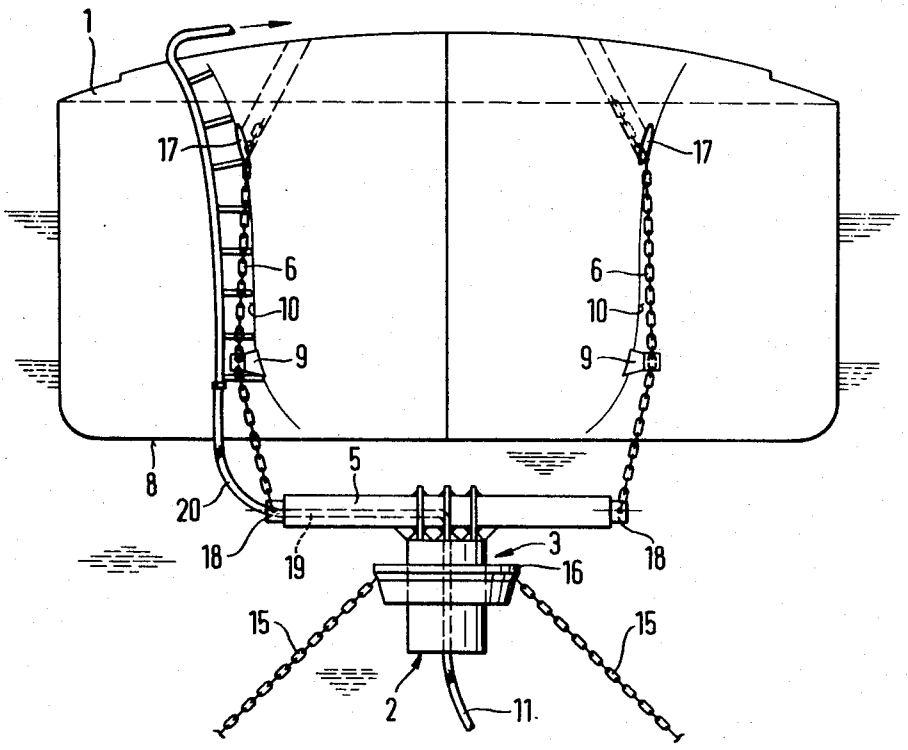
Figure 4:
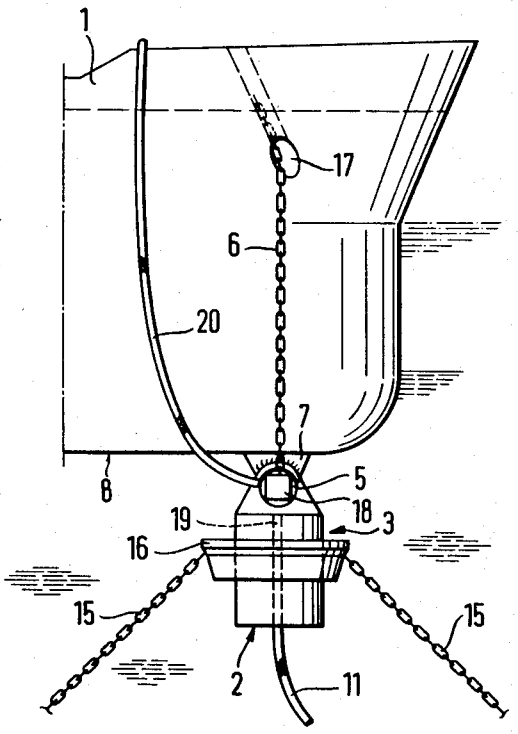
FIGS. 3 and 4 show views similar to FIGS. 1 and 2 except that the spreader bar is located in a half-shell bearing at the bottom of the tanker.

Referring to the figures, the anchoring arrangement illustrated enables the anchored structure, such as a tanker 1, to oscillate or turn freely around the point of anchorage, the arrangement being such that continuity in the transfer tube 19 is ensured in spite of rotary movements of the tanker with respect to the anchoring structure. The continuity is made possible by a swivel pipe joint 13.

Figure 3:
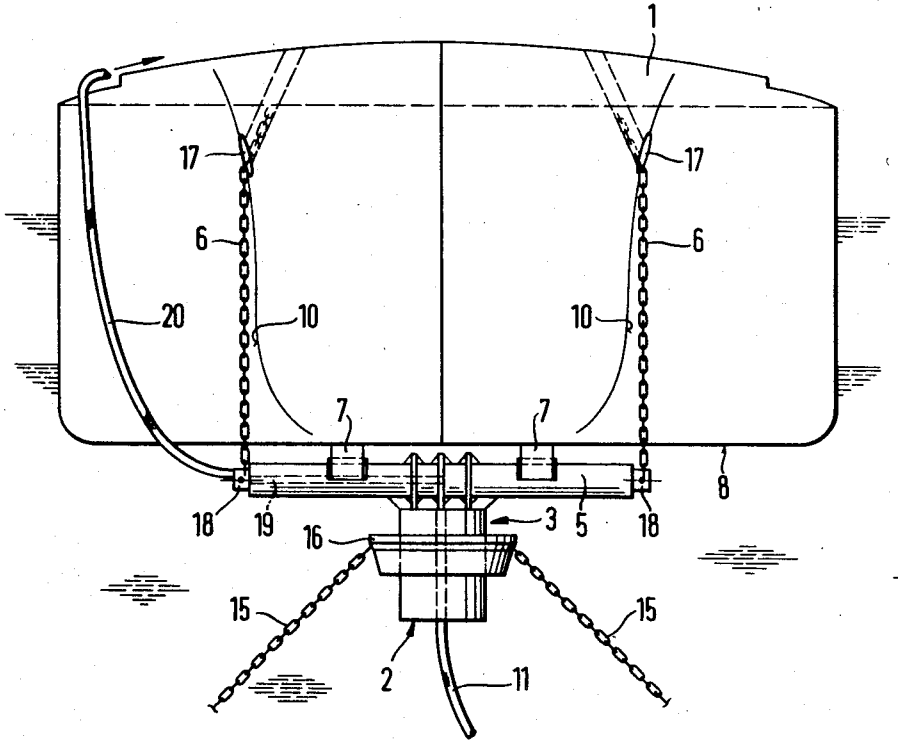
Figure 5:
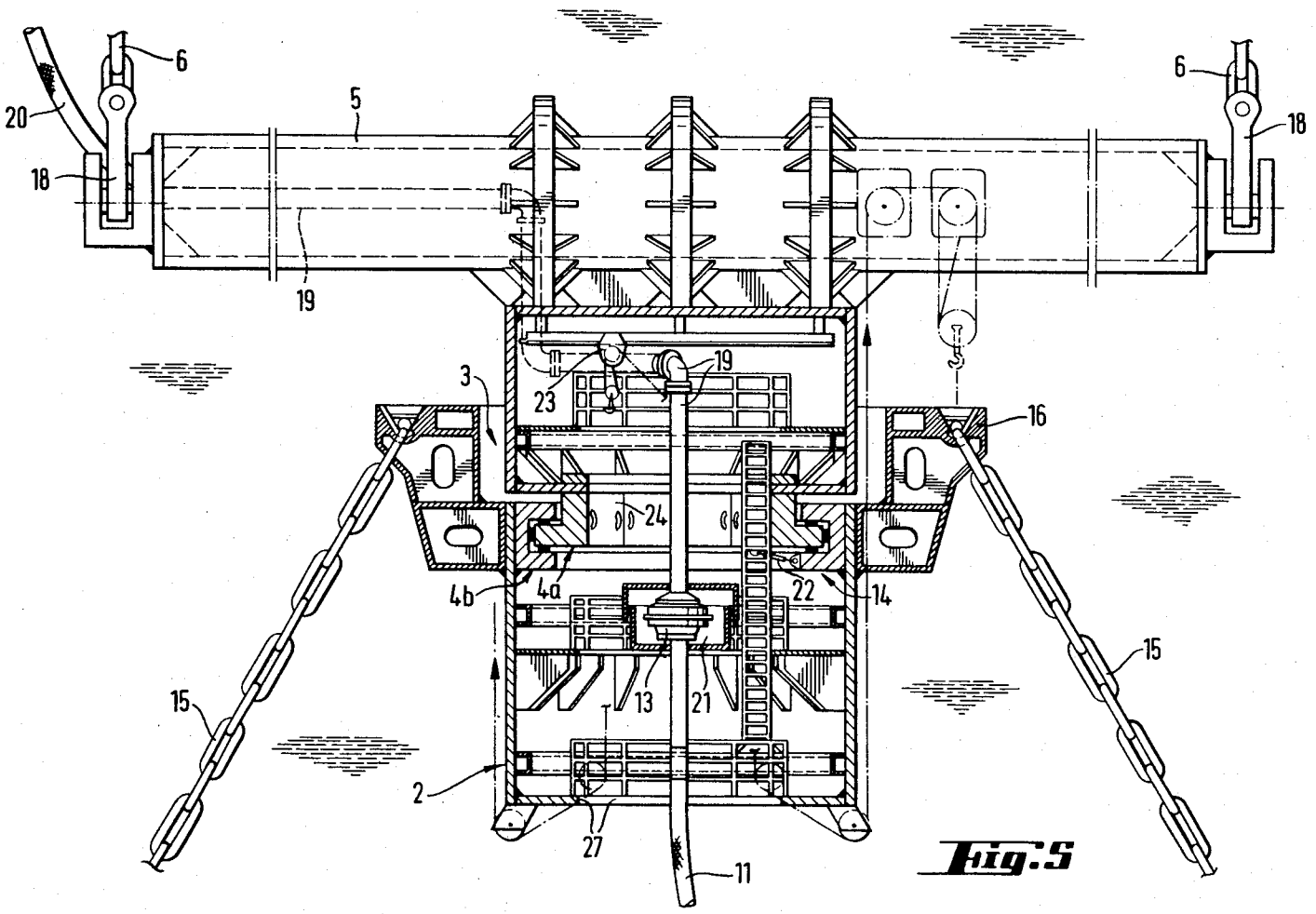
FIGS. 5 to 7 show details of the underwater chamber fastened to the spreader bar via a support column and pivot bearing
Figure 6:
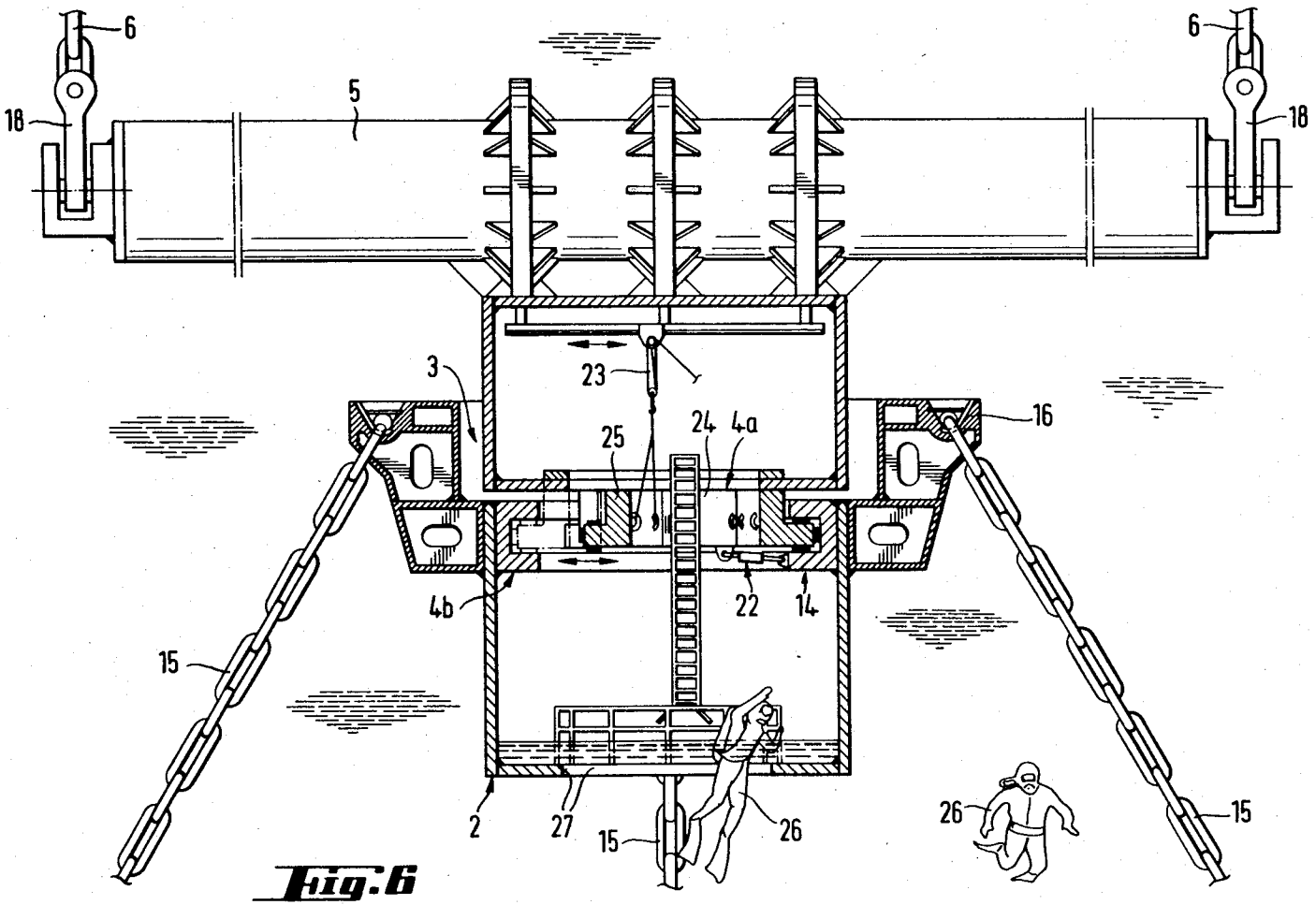
Figure 7:
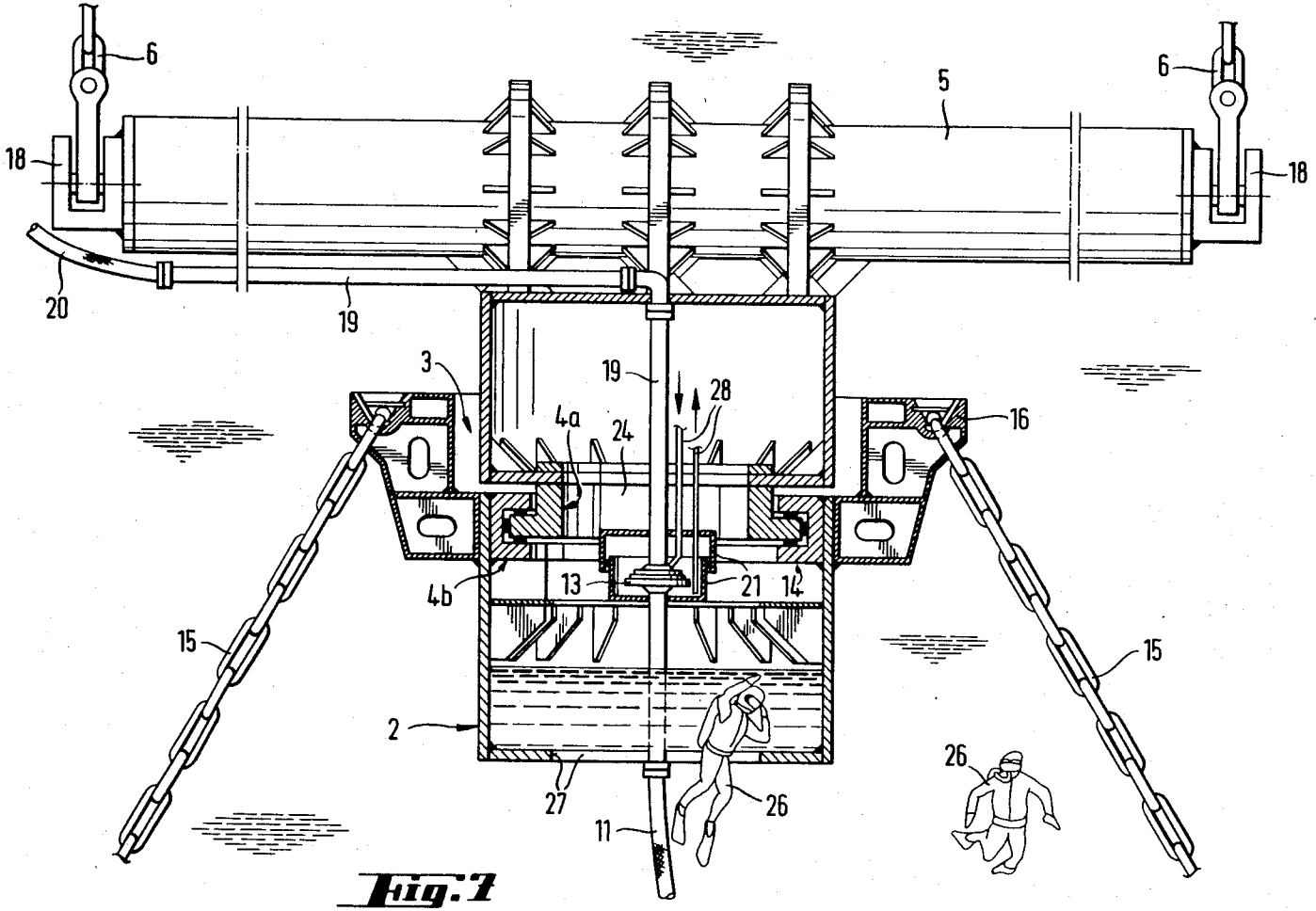

As described, the installation consists of an underwater chamber 2 which is suspended from a spreader beam or bar 5, the chamber 2 containing a support column 3 which preferably takes the form of a massive pivot bearing 14. Anchoring chains 15, which are well known per se in the prior art, are suspended radially outwardly from a revolving platform 16 surrounding the chamber 2. The spreader beam 5 is suspended on anchor-riding stoppers in a so-called cross-beam fashion by two mooring hawsers 6 which pass through hawse-holes 17 in the side of the tanker. The mooring hawsers 6 may be:

(a) either guided on the outer shell 10 of the tanker 1 in a seating or locating guide 9 below which is suspended the spreader beam 5 held at the ends by a cardan-like universal-joint-like two-axis suspension attachment 18; or (b) alternatively so disposed that the spreader bar 5 is guided under the bottom 8 of the tanker 1 and drawn by the mooring hawsers 6 into two half-shell-bearings 7 where it is retained, as may be seen from FIG. 3.

In general, the underwater chamber 2 is flooded in normal use and is without buoyancy, so that the plastic coated pivot bearing 14 of the support column 3 is continuously lubricated with sea water. For maintenance purposes, the underwater chamber 2 may be evacuated in accordance with the diver's lock principle and then rendered dry by a diver 26 who can enter the chamber through the opening 27.

The pivot bearing 14 of the support column 3 is advantageously segmentally divided as indicated at 24. Further, for purposes of maintenance, the rotational functioning of the pivot bearing 14 can be temporarily blocked by 22 whereby individual segments of the parts **4*a* of the pivot bearing 14, which are movable with respect to the chamber, can be swung out by means of a hoist 23 and inspected, as indicated at 25**.

The temporary blocking operation by 22 may be most simply effected by means of two spanners which grip, by means of lugs, the ring-bearing part **4*b* fixed to the chamber 2, on the one hand, and, on the other hand, grip the rotatable part 4*a*** of the ring-bearing located diametrically opposite on the periphery.

The flexible transfer hose 11 coming from the sea bed (not shown) is taken through the center of the chamber 2 where a rotary swivel-joint 13 is located, the function of which is to allow for the rotation of the chamber 2 with respect to the tube 19. The tube 19 is a relatively rigid tube and is disposed along the spreader beam 5. A flexible hose 20 connected to the rigid tube 19 bypasses the cardan or universal joint suspension attachment 18 mounted on the spreader beam 5.

The swivel joint 13 is enclosed in a collecting chamber 21 which collects any liquid that leaks into the chamber 21 and feeds it to the tanker 1, as may be required, via suitable pressure lines 28. By this means, contamination and fouling of the water medium and environment are prevented.

It is noteworthy that the anchoring arrangement provided by this invention, as described hereinabove, requires a relatively smaller amount of steel for the chamber construction as compared with other prior art arrangements which might offer comparable advantages or features, if any. Also significant in the present invention is the fact that the working space required near the tanker structure to be anchored is rather minimal compared with other known arrangements.

Other advantages, and unique and novel features, obtained from the invention described hereinabove include:

(1) easy application of the anchoring arrangement of the invention to decommissioned tankers in high seas, allowing for oscillating and rotating movements of the tanker while the transfer hose coming in from the sea bed stays connected;

(2) the massive pivot bearing mechanism which comprises sections **4*a*, 4*b*** which can be inspected separately by temporarily interrupting the relative rotary movement between the tanker and the anchoring mechanism;

(3) the hollow/underwater chamber 2 which operates on the diver's lock principle, provides a dry atmosphere within for maintenance personnel to work on the pivot bearing and the collecting chamber 21;

(4) a "one point vertebra" arrangement which permits the use of a plurality of anchor chains; and (5) half-shell type, split bearing 7 which stably locates the spreader beam 5 so as to promote stability.

The description given hereinabove is with reference to a preferred embodiment, which is exemplary of the invention. The invention is not to be taken as limited to all of the details thereof, as modifications and variations thereof may be made without departing from the spirit or scop of the invention.

What is claimed is:

1. An underwater anchoring arrangement for floating structures, such as a tanker in high seas, of the type using a plurality of anchoring ropes and mooring hawsers, the tanker having a hull, the anchoring arrangement comprising:

a spreader beam suspended in a substantially horizontal manner under the tanker and supported by a plurality of mooring hawsers which are guided on the hull of the tanker;

a support column structure rigidly suspended from and supported by said spreader beam, said support column structure having a structural portion with a substantially vertical axis, said support column structure including a diver's chamber, said diver's chamber housing a bearing means enabling relative rotary motion of said diver's chamber about said vertical axis with respect to said structural portion of said support column structure, said bearing means providing support for said structural portion in a direction along said vertical axis and a direction radial thereof; and a plurality of anchor chains connected to and holding down said diver's chamber so as to anchor the tanker through the support column structure, whereby the tanker together with the spreader beam is capable of rotary oscillatory movement about said vertical axis with respect to the anchored diver's chamber.

2. The anchoring arrangement as in claim 1 including half-shell bearings disposed at the bottom of said tanker facilitating retention of said spreader beam with the tanker.

3. The anchoring arrangement as in claim 2 including lateral suspension attachments held by said mooring hawsers.

4. The anchoring arrangement as in claim 3 wherein said bearing means comprises sections which can be individually hoisted for inspection within said diver's chamber.

5. The anchoring arrangement as in claim 1 including half-shell type split bearing means disposed at the bottom of said tanker to receive and hold said spreader beam in a stable manner.

6. The anchoring arrangement as in claim 5 including a platform which is disposed extending from said diver's chamber, said plurality of anchoring chains being connected to said platform.

7. The anchoring arrangement as in claim 5 including universal joint type suspension means serving to connect said spreader beam and said plurality of mooring hawsers.

8. An underwater anchoring arrangement for floating structures, such as a decommissioned tanker in high seas, of the type using a plurality of anchoring ropes and mooring hawsers, the tanker having a hull, the arrangement comprising:

a spreader beam suspended in a substantially horizontal manner under the tanker and supported by mooring hawsers which are guided on the hull of the tanker;

a support column structure supported by and suspended from said spreader beam, said support column having a substantially vertical axis, said support column structure including a diver's chamber formed at the bottom end of said support column, said diver's chamber being capable of relative rotary motion with respect to said spreader beam, a pivot bearing means located within said diver's chamber and disposed circumferentially in said chamber to permit said relative rotary motion;

a revolving platform formed as a peripheral extension of said diver's chamber; and a plurality of anchor chains connected to and holding down said platform together to fasten and anchor said diver's chamber, whereby the tanker, together with the spreader beam, is capable of rotary oscillations about said vertical axis with respect to the fastened and anchored diver's chamber.

9. The anchoring arrangement as in claim 8 including half-shell bearings disposed at the bottom of the tanker, facilitating retention of said spreader beam with the tanker.

10. The anchoring arrangement as in claim 9 including lateral suspension attachments held by said mooring hawsers.

11. The anchoring arrangement as in claim 10 including half-shell type bearing means disposed at the bottom of said tanker to receive and hold said spreader beam in a stable manner.

12. The anchoring arrangement as in claim 11 including a fluid tight swivel joint disposed within said diver's chamber, which swivel joint serves to connect a transfer tube which emerges from the tanker through said spreader beam, with an underwater flexible hose which is led into said diver's chamber.

13. A permanent anchoring arrangement for a floating structure, such as a decommissioned tanker, said floating structure having a hull portion, said arrangement being for anchoring said structure on the high seas, said arrangement comprising:

a support column, said support column having a substantially vertical axis, said support column being rotatable around the vertical axis thereof, the anchoring arrangement having several anchoring ropes and several mooring hawsers which lead to the structure;

an underwater chamber for being entered by divers and for being flooded and blown-out, said underwater chamber being operable as a diver lock, said chamber having oppositely located rotatable support column parts, said chamber enclosing and carrying said oppositely located rotatable support column parts, the arrangement including a spreader bar from which the underwater chamber is suspended, said hull portion having guides disposed thereon;

said spreader bar being retained by said mooring hawsers, said mooring hawsers being seated in said guides disposed on said hull portion of said structure.

14. The anchoring arrangement in accordance with claim 13 wherein the spreader bar, which is carried by said mooring hawsers, is retained in half-shell bearings disposed at the bottom of the ship.

15. The anchoring arrangement in accordance with claim 14, wherein said mooring hawsers are carried mounted on a shell portion of said tanker by means of lateral suspension attachments.

* * * * *